United States Patent [19]

Sharp

[11] Patent Number: 4,881,579

[45] Date of Patent: Nov. 21, 1989

[54] LIQUID OVERFILL TANK ASSEMBLY

[76] Inventor: Bruce R. Sharp, 4090 Rosehill Ave., Cincinnati, Ohio 45229

[21] Appl. No.: 66,701

[22] Filed: Jun. 26, 1987

Related U.S. Application Data

[63] Continuation-in-part of Ser. No. 858,656, May 1, 1986, abandoned.

[51] Int. Cl.[4] ..... B65B 3/06

[52] U.S. Cl. ..... 141/86; 141/311 A; 285/381

[58] Field of Search ..... 141/86, 286, 326, 311 A, 141/88; 174/DIG. 8; 220/85 F, 85 VR, 86 R, 256, 314, 324, 309, 315, 245, 248; 285/381; 137/571, 575, 576

[56] References Cited

U.S. PATENT DOCUMENTS

| | | | |
|---|---|---|---|
| 3,045,861 | 7/1962 | Dieter et al. | 220/314 |
| 3,388,931 | 6/1968 | Johnson et al. | 285/381 |
| 3,633,219 | 1/1972 | Byrd | 4/10 |
| 3,871,401 | 3/1975 | Lyons | 137/381 |
| 3,924,778 | 12/1975 | Sorensen | 220/314 |
| 4,204,564 | 5/1980 | Balfour | 141/311 |
| 4,270,728 | 6/1981 | Peloza | 285/381 |
| 4,278,115 | 7/1981 | Briles et al. | 141/86 |
| 4,416,836 | 11/1983 | Sinek | 261/112.1 |
| 4,457,349 | 7/1984 | Vazin | 141/86 |
| 4,520,852 | 6/1985 | Klein | 141/286 |
| 4,521,041 | 6/1985 | Cox et al. | 285/381 |
| 4,569,868 | 2/1986 | DeBlauwe et al. | 174/DIG. 8 |
| 4,593,714 | 6/1986 | Madden | 137/371 |
| 4,615,362 | 10/1986 | Hartman et al. | 141/86 |
| 4,637,522 | 1/1987 | Klop | 220/86 R |
| 4,655,361 | 4/1987 | Clover et al. | 220/85 |
| 4,659,251 | 4/1987 | Petter et al. | 405/52 |
| 4,696,330 | 9/1987 | Raudman et al. | 141/86 |
| 4,706,718 | 11/1987 | Milo | 141/86 |
| 4,721,094 | 1/1988 | Nett | 220/314 |

*Primary Examiner*—Henry J. Recla
*Assistant Examiner*—J. Casimer Jacyna
*Attorney, Agent, or Firm*—Charles R. Wilson

[57] ABSTRACT

An assembly for controlling overfill of liquid to an underground storage tank during a filling operation comprises a dump tank, a fill tube positioned within the dump tank, piping with valve and a cover. The fill tube within the dump tank is encased with a shrink-fitting covering which extends from the bottom portion of the dump tank to ensure a liquid tight overfill assembly.

21 Claims, 5 Drawing Sheets

LIQUID OVERFILL TANK ASSEMBLY

This application is a continuation-in-part of "Overfill Tanks For Use On Storage Tanks", Ser. No. 06/858,656, filed May 1, 1986, now abandoned and of "Overfill Assembly With Removable Lid", Ser. No. 07/050,696, filed May 18, 1987.

This invention relates to an assembly for attachment to a storage tank for collecting overfilled liquid. More particularly, the invention relates to an overfill assembly useful with underground storage tanks.

BACKGROUND OF THE INVENTION

Storage tanks for holding bulk quantities of liquid are used throughout industry. Gasoline service stations make wide use of underground storage tanks which hold from about 10,000 to 40,000 gallons of gasoline. These tanks are filled periodically from transport trucks. Usually a fill connection is found at ground level for easy filling. A delivery hose is simply connected to the fill connector and gasoline pumped from the truck to the tank. Automatic shut-off valves ensure that dispensing of the gasoline is controlled. However, faulty delivery hoses, poor line connections or even operator error can result in gasoline being spilled at the fill connection. Any spill is generally small and is readily absorbed into the environment. However, continued spilling over a period of time or one large spill poses a substantial health hazard.

Various devices have been suggested for use in minimizing gasoline spills during a filling operation. U.S. Pat. Nos. 3,732,902, 4,204,564, 4,457,349 and 4,615362 disclose overfill pits and tanks of various designs. None, however, have proven to be completely satisfactory. Any overfill tank must be capable of ready attachment to a storage tank and be reliable. In particular, stress points which can lead to cracking or potential sources of spill leakage must be eliminated. Additionally, access to the interior of the overfill tank for filling purposes must be readily accomplished. Because a transport tank is restricted a to where it can park for unloading, the fill tank's delivery hose may lead to the overfill tank from any direction. Access to the fill connections of any overfill tank must be able to accomodate such delivery hoses.

There has now been developed an overfill assembly which is economical to produce, yet which fills a long felt need. The assembly has a minimum of connections so as to reduce substantially any possibility for early failure. Additionally, the assembly is readily installed on a storage tank.

SUMMARY OF THE INVENTION

An assembly for use on underground storage tanks comprise a dump tank with an opening at its top whereby access is gained to its interior and an opening at its bottom to accomodate a fill tube, a fill tube within the dump tank and extending therethrough, piping with a valve extending from the dump tank's interior to the fill tube and a cover for the dump tank. The assembly has a unitary structure with a shrink-fit covering over the fill tube extending from the point where the fill tube enters the dump tank bottom.

DETAILED DESCRIPTION OF THE INVENTION

Figure 1:
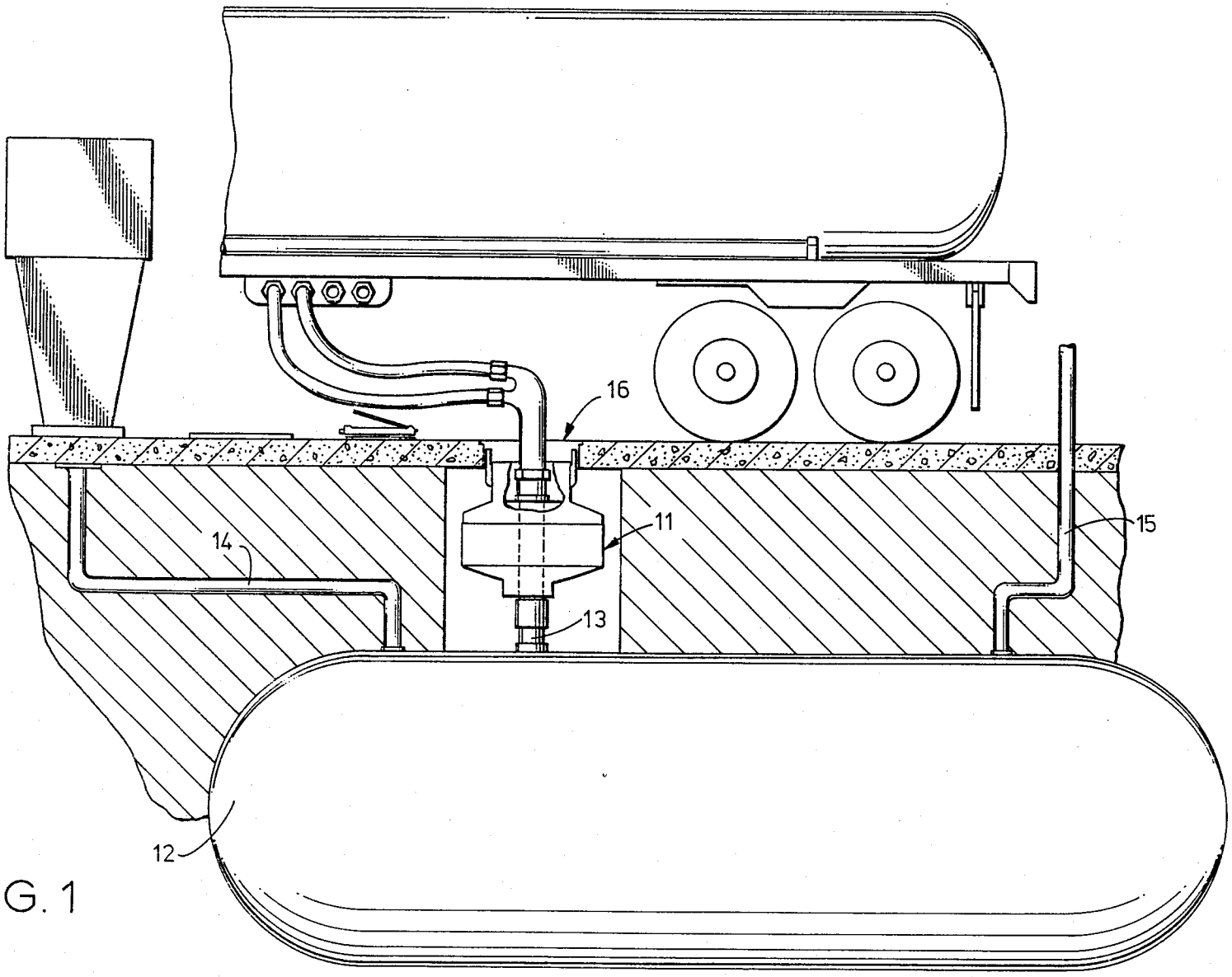
FIG. 1 is a view in perspective of an underground storage tank with the overfill assembly of this invention mounted thereon.

The overfill assembly of this invention is shown generally as 11 in FIG. 1. The assembly is useful with any type of bulk storage tanks, though is particularly useful with an underground storage tank for gasoline as found most commonly in retail service stations. Storage tank 12 is typically made of steel or a fibrous reinforced resinous material. A fill line 13, dispensing line 14 and vent pipe 15 all extending into the storage tank's interior and fulfill known functions. The fill line 13 enters the tank at an opening in the top surface of storage tank 12. Dispensing line 14 and vent pipe 15 can also enter the storage tank through their own openings as depicted or through a manhead as formed on certain storage tank designs. The overfill assembly 11 is mounted on top of storage tank 12 with a ground surface opening 16 allowing access to the assembly.

Figure 2:
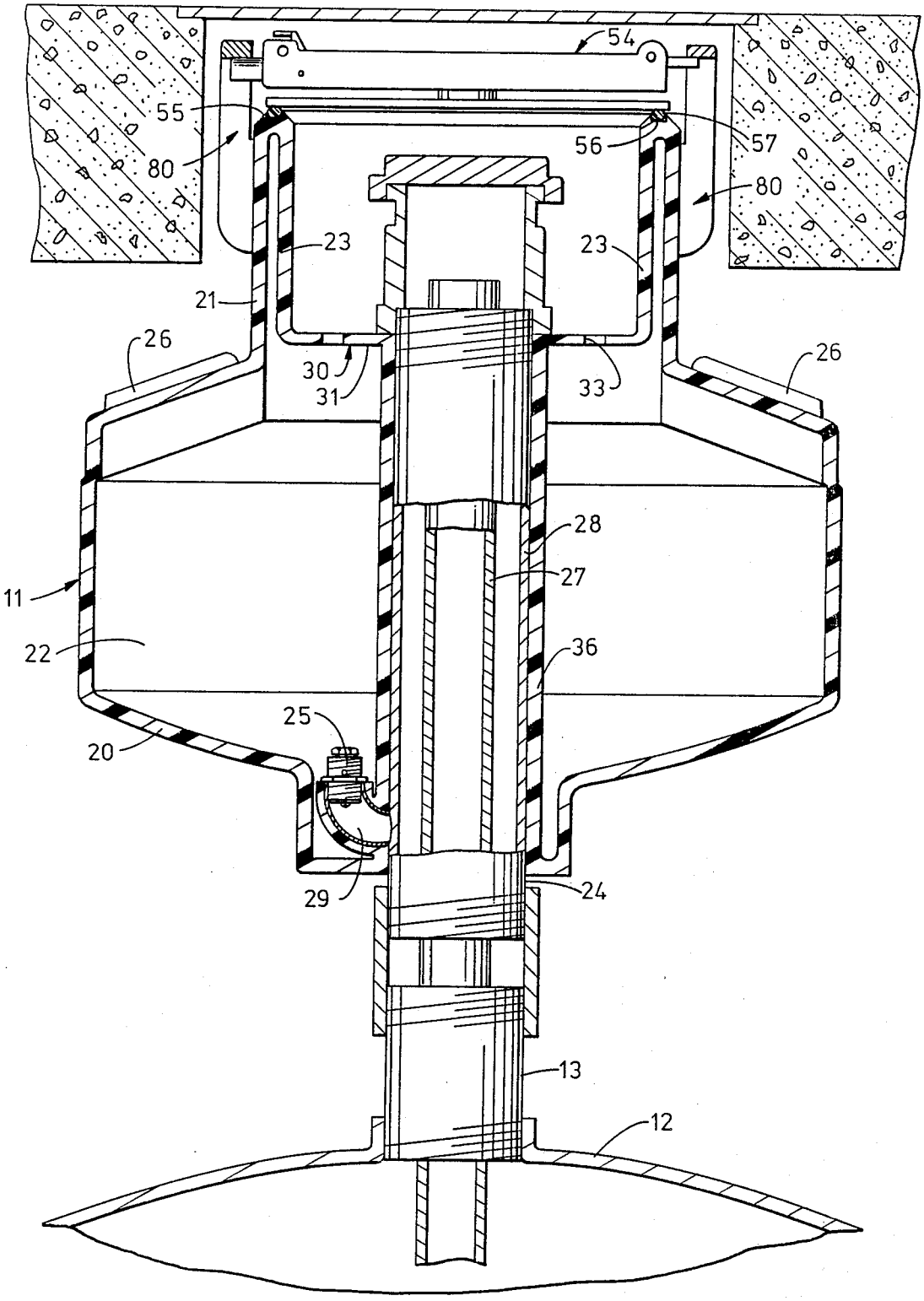
FIG. 2 is a front view in section of the overfill assembly depicted in FIG. 1.

As best shown in FIG. 2, overfill assembly 11 comprises a dump tank having bell shaped body 20 dimensioned to hold up to about thirty-five gallons of liquid. Generally, though, the shape and exact capacity of the overfill assembly is not particularly important. An elongated neck portion 21 extends from reservoir portion 22 with an opening at its top. Preferably, the neck has a double-wall 23 to allow fill tube attachment means to be secured thereto. An opening at the bottom of the overfill assembly is provided for accomodating a fill tube 24. Ribs 26 are optionally provided on the exterior surface of the reservoir portion 22 as an aid in installing the assembly to a fitting found in the storage tank and for providing added strength.

Figure 3:
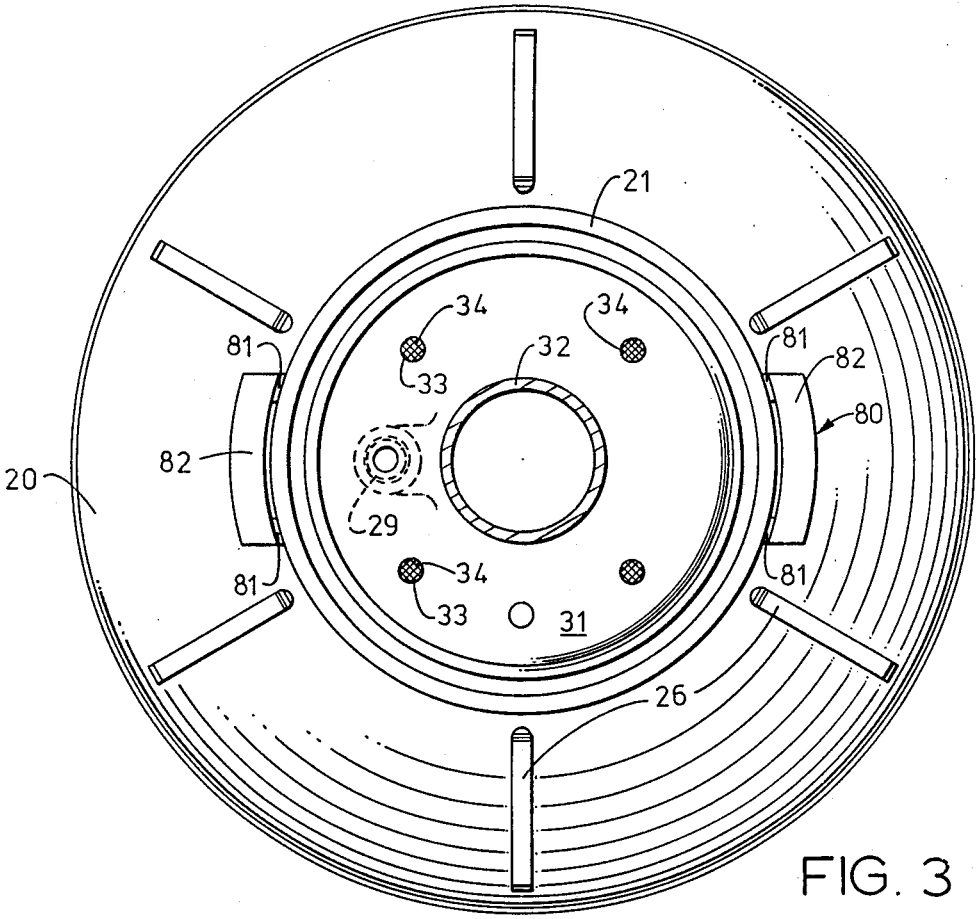
FIG. 3 is a top view of the overfill assembly of FIG. 2
Figure 6:
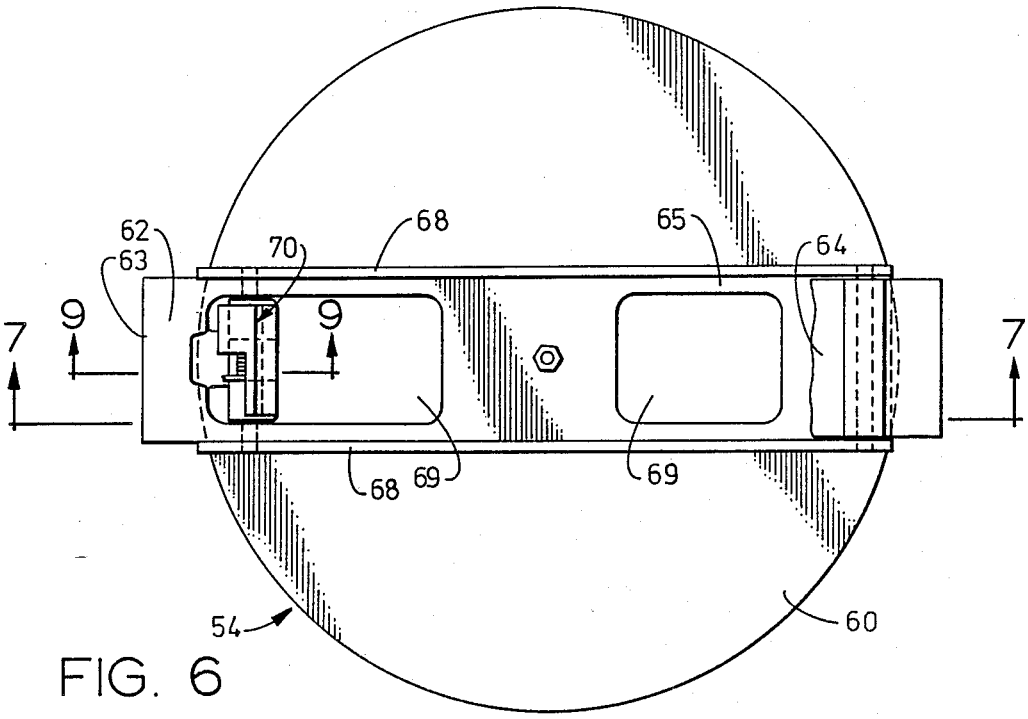
FIG. 6 is a top view of a removable center-point compression sealing cover used on the overfill assembly of FIG. 2.

Fill tube 24 extends from a point within the elongated neck through the opening in the bottom wall of the reservoir 22 and a short distance beyond. The fill tube is comprised of an inner fill pipe 27 through which liquid flows and an outer vapor recovery pipe 28. The area between the two pipes is used for vapor recovery purposes. Coaxial fill tubes of this general nature are commonly used in the gasoline storage tank industry. Single wall pipes are useable when the particular industry permits their use. The upper portion of fill tube 24 is held in a steady position by attachment means 30 radiating from near its first extremity to the interior neck walls 23 of the dump tank. Various attachment means can be used to hold the fill tube in approximate center point alignment with the neck walls. As best shown in FIG. 3, a plate 31 with a center hole 32 to accomodate the fill tube is attached to the neck walls. Openings 33 are provided to allow excess liquid from a filling operation to overflow from the fill tube to reservoir 22. Screens 34 are permanently attached to the openings 33 to filter out unwanted debris. Other attachment means such a brackets forming a spoke-configuration can radiate from the fill tube to the double wall 23.

As evident from FIG. 2, a second extremity of fill tube 24 near its bottom is held in position by the bottom walls of the reservoir 22. Extending from the bottom of the reservoir is a shrink-fit covering 36 which encases the fill tube at least one inch along its length, preferably to near the tube line's first extremity at the top. In effect, the covering 36 is an extension of the reservoir walls. The fill tube is not removable from the dump tank. Because of this construction, there is no possibility of spilled liquid seeping out through the reservoir at the fill tube's exit.

Figure 4:
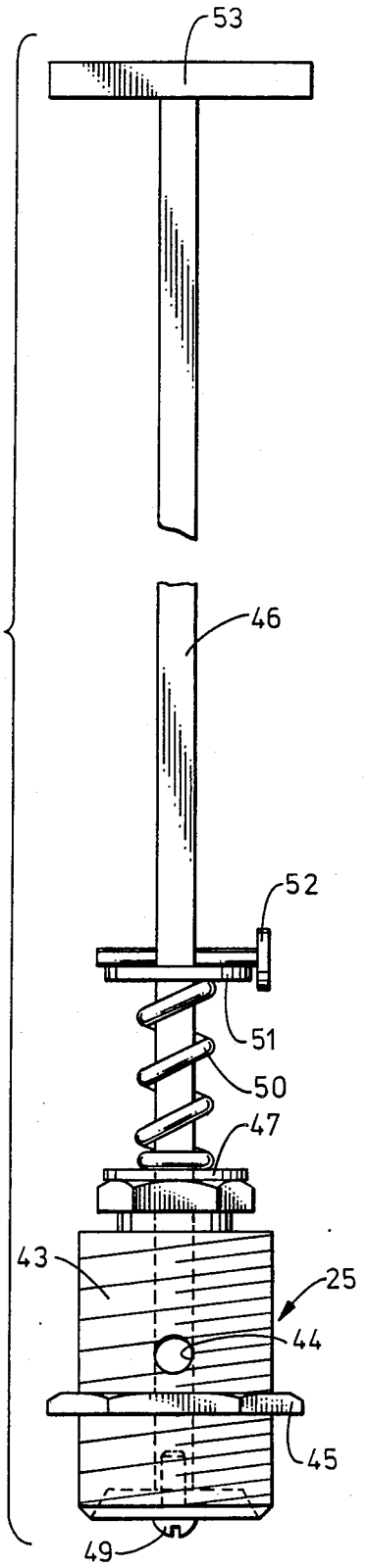
FIG. 4 is a front view of a valve used with the overfill assembly of FIG. 2.
Figure 5:
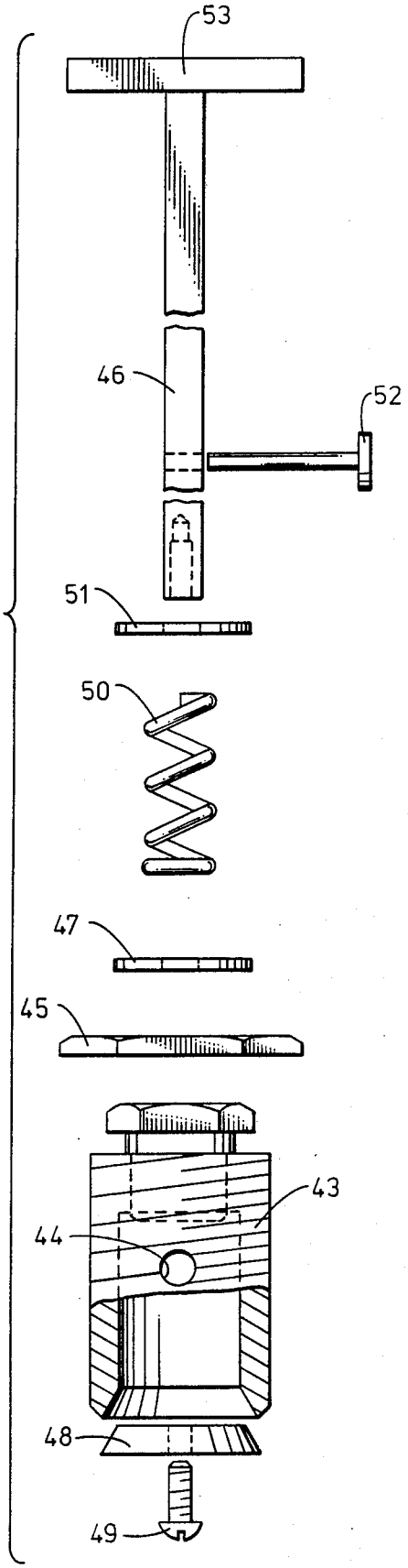
FIG. 5 is an exploded view of the valve of FIG. 4.
Figure 7:
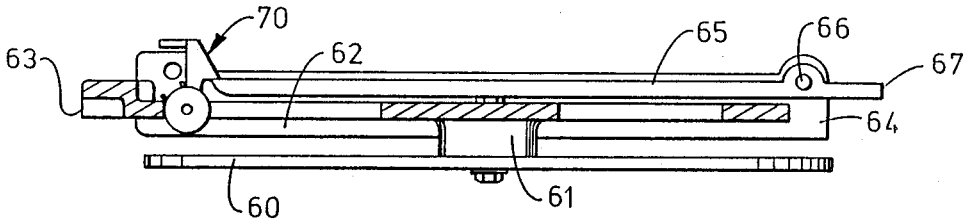
FIG. 7 is a side view in section of the cover of FIG. 6 taken along line 7—7 of FIG. 6.
Figure 8:
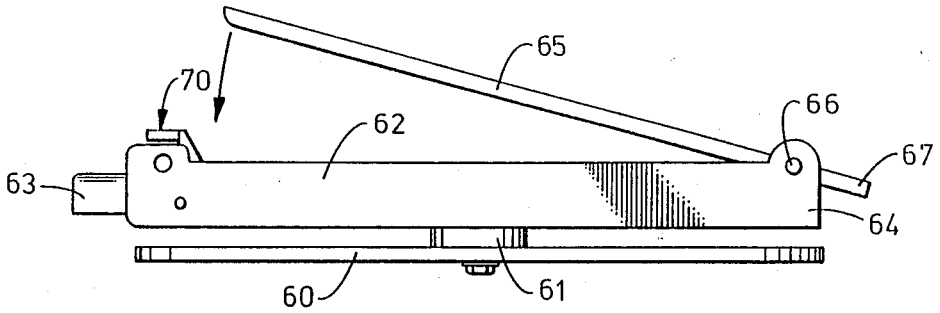
FIG. 8 is a side view of the cover of FIG. 6 with its lever bar in a raised position.

Piping 29 extends from the dump tank's interior bottom to the fill tube 24 at a location either inside (as shown in FIG. 2) or outside of the reservoir. A valve 25 is associated with the piping 29 to allow a controlled flow of liquid found in the reservoir 22 to the storage tank. Any valve which provides directional flow control can be used. Shown in FIGS. 4 and 5 is a manual valve adapted for installation in the bottom opening. As shown, the valve 25 is comprised of a hollow threaded fitting 43 with at least one drain hole 44 extending to the hollow center. A retaining nut 45 is used to lock the fitting into the bottom opening. A push rod 46 extends from near the top of the overfill's top interior surface through a shoulder 47 on the fitting and into the hollow center. A washer 48 dimensioned to form a sealed closing with a recess in the bottom of the fitting 43 is secured to the end of push rod 46 by a screw 49. A spring 50 with stop shoulder 51 and stop pin 52 are positioned on the rod to ensure that washer 48 forms a sealed closing when in a rest position. A handle 53 is provided to manually operate the opening of the valve. In operation, when a downward force is exerted on the push rod, the rod's extremity with washer 48 is forced downwardly thereby permitting any spilled liquid to flow through drain hole 44, into piping 29, and to the storage tank.

A lid member 54 shown generally in FIG. 2 fits over the opening at the top of the elongated neck 21 to form a sealed closing. For this purpose, the top rim 55 of the opening comprises a groove 56 for holding O-ring 57. Each edge is beveled downwardly so that any debris which may fall onto the rim will not remain there. Absence of debris aids in a better seal when cover 54 rests directly on the O-ring. Depicted is a center-point compression sealing cover. Such covers operate by having a center closing force transferred evenly to the edges of the cover and exerted downwardly onto the O-ring.

With reference to FIGS. 6–9 there is shown in detail a particularly useful center-point compression sealing cover which is completely removable from the elongated neck. Cover 60 is dimensioned to fit over the opening at the dump tank's neck. The cover has a center point spacer 61 attached in the approximate center of the cover. A force transfer bar 62 is attached to the spacer 61. The force transfer bar extends substantially across and through the middle of cover 60. One end 63 of the force transfer bar extends over an edge of the cover. The other end 64, extending to near an opposite edge of cover 60, has a lever bar 65 hingably attached to it by pin 66. The lever bar pivots about pin 66 to either exert or release a force when the lid member is in use. One end 67 of the lever bar extends past an edge of the cover 60. When lever bar 65 is forced downwardly during use, it preferably becomes flush with the force transfer bar 62. Ridges 68 on each side of the force transfer bar in effect provide a recessed inner area in which lever bar 65 fits. Openings 69 in lever bar 65 allow water and debris to pass through and prevent any unwanted build-up on force transfer bar 62 which could prevent proper closing on cover 60.

Figure 9:
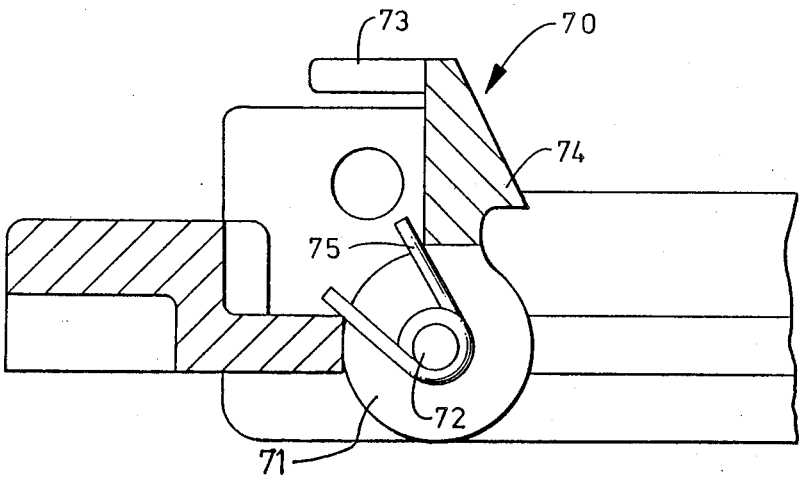
FIG. 9 is a side view in section of the latch found on the cover of FIG. 6.

A latching means is provided to hold lever bar 65 in place. A spring latch 70 is provided on the force transfer bar to receive and hold one extremity of the lever bar 65. As best seen in FIG. 9, spring latch 70 has a body 71 which is attached by pin 72 to force transfer bar. The body 71 has a thumb catch release 73 which when pushed downwardly causes body 71 to revolve about its pin 72. The lip of latch 74, holding the lever bar, is forced to revolve and release the lever bar. A spring 75 causes the latch body to return to its rest position when the force is removed from the thumb catch release.

The neck of the overfill assembly has retaining means for accomodating sealing removable lid member 54. As best seen in FIG. 3, the retaining means 80 is a set of brackets 81 extending from the neck opposite one another. The brackets are attached by bolts or other suitable means to the neck. A retainer cross-pin 82 extends across the brackets and is for the purpose of receiving the lid member. The lid member is removable so as to aid in a filling operation. That is, a delivery hose from the tank truck can readily gain access to the fill pipe 24 from any direction without being blocked by a hinged lid protruding above ground level. Complete removal of the lid member allows the tank truck operator to set it aside during his fill operation. This also allows a smaller ground level access pit to be used than with a hinged lid assembly. This is particularly true with a round access pit. A problem of having to have a hinged lid aligned with a side of a square access pit to maintain a reasonably sized opening is also avoided. At the same time, the excellent sealing qualities of a center point compression lid member are retained.

To seal off the dump tank's interior from ground water or retain vapors inside, the removable lid member of FIGS. 6–9 is positioned over the tank's opening depicted in FIGS. 2 and 3 and is closed by first placing end 63 of force transfer bar 62 under a retainer pin 82 at about a forty-five degree angle with lever bar 65 raised preferably ninty degrees perpendicular to cover 60. Once cover 60 is lowered and approximately horizontal, the lever bar 65 is pushed down towards the force transfer bar 62 resulting in end 67 of the lever bar being force under a second retainer pin 82. After the lever bar is pushed down flush with force transfer bar the spring latch holds the lever bar in place. When the lever bar 65 is in the closed position down upon force transfer bar 62, the spacer 61 is force downward thereby forcing the cover 60 downward. The outer edge of cover 60 is forced down evenly on the top edges of the dump tank's neck. The cover can be deflected into a concave structure formed by center point pressure of spacer 61 and effectively forms a tightly sealed enclosure.

The dump tank with fill tube properly positioned is made by a roto-molding process using a synthetic polymer. Roto-molding processes for producing various items are well known. Herein, a removable mold with a metal fill tube in place is charged with polymer powder. The mold is then rotated in all directions while applying heat. Centrifugal force from the rotation operation forces the powder to the walls of the mold and fill tube where the heat melts it. When the process is stopped, an essentially unitary structure is produced. Proper placement of mold material and processing conditions can result in the production of desired configurations. For example, the interior bottom of the dump tank of FIG. 2 where the piping is positioned can be filled-in. In effect all sources of possible leaks are eliminated by encasing such with the synthetic polymer. The assembly with its unitary structure is leak-proof, strong and ready for installation on an existing storage tank.

In operation, the overfill assembly is securely attached to the top surface of a storage tank. The fill tube in the assembly extends through the bottom surface and leads to the interior of the storage tank. A transport truck operator removes the cover and, if need be, any fill tube cap. A delivery hose is connected to the fill tube and pump means activated to transport a liquid through the hose, fill tube and into the storage tank. The pump is shut off when the tank is filled. Disconnection of the delivery hose will allow any liquid still within the hose to drain into the reservoir. Opening of the valve mechanism will allow the overfilled liquid to drain through piping into the storage tank's head space to the extent there is room. Any excess liquid will eventually drain into the storage tank as space permits.

The overfill assembly of this invention has been described with particular reference to the drawings. Various obvious modifications may be made without departing from the scope of coverage of the appended claims. For example, other drain valves such as float check valves with automatic draining can be used. Covers of all types which can be hingably attached for the sealing the dump tank's interior can also be used. As one example, the cover depicted in FIGS. 6–8 can be converted to a hinged cover by placing a rotatable pin through the extending end of the force transfer bar and attaching it to side brackets mounted on the elongated neck's outer walls. Still other obvious changes can be made.

What is claimed is:

1. An assembly for use with an underground liquid storage tank to control overfill of liquid during a filling operation, comprising:

(a) a dump tank molded of one piece construction from a polymeric material having a reservoir portion with a bottom wall and a neck extending from the reservoir portion wherein the bottom wall has an opening to accommodate a fill tube and the neck has an opening at its top whereby access is gained to the interior of the dump tank;

(b) a fill tube securely positioned in said dump tank with a first extremity near the dump tank's neck and a second extremity extending through the opening in the dump tank's bottom wall, further wherein an extension of the bottom wall of the reservoir portion of the dump tank extends at least one inch along the fill tube's length from the point where the fill tube's second extremity enters said dump tank bottom wall to encase the at least one inch of the fill tube with a shrink-fit covering to ensure that liquid which spills into the dump tank will not seep therethrough;

(c) piping which extends from the dump tank's reservoir portion to the fill tube;

(d) a directional flow control valve associated with the piping through which overfilled liquid can flow in response to opening of the flow control valve; and (e) a cover for fitting over the opening at the top of the dump tank neck so as to form a sealed closing of the dump tank.

2. The assembly of claim 1 further wherein the fill tube is secured to the dump tank by attachment means radiating from near the first extremity of said fill tube to the neck.

3. The assembly of claim 2 wherein the attachment means is a plate which is permanently attached to the fill tube and the neck, said plate having openings for allowing excess liquid to pass therethrough into the body of the dump tank.

4. The assembly of claim 3 wherein a removable screen is positioned over each opening in the plate to catch particulate matter.

5. The assembly of claim 4 wherein the neck of the dump tank is a double walled neck.

6. The assembly of claim 5 wherein the double walled neck and the plate attached to the fill tube are unitary in structure.

7. The assembly of claim 6 wherein the dump tank is made of a polymeric material by a roto-molding process.

8. The assembly of claim 2 wherein the piping extends into the fill tube at a point inside of the dump tank.

9. The assembly of claim 1 wherein the fill tube is threaded on its second extremity for ready attachment to an underground storage tank fill opening.

10. The assembly of claim 9 wherein the dump tank has a series of gripping ribs on its exterior top surface for accomodating a turning tool allowing convenient threading of the dump tank to the underground storage tank.

11. The assembly of claim 1 wherein the cover is completely removable, said cover comprising:

(i) A lid dimensioned to completely cover the opening in the top of the dump tank with a spacer permanently positioned in the approximate center of the lid;

(ii) a force transfer bar permanently positioned over the spacer and extending across the lid from one outer extremity to the other outer extremity, said force transfer bar having means on its first extremity to engage, when properly aligned, a first retaining means found on the dump tank; and (iii) a lever bar pivotably mounted on the force transfer bar's second extremity to engage a second retaining means found on the dump tank and said lever bar being sufficiently long enough so that when the cover assembly is positioned on the dump tank's top opening with the means on the first extremity of the force transfer bar aligned with the first retaining means of the dump tank and the means on the second extremity of the lever bar aligned with the second retaining means of the dump tank and downward force is exerted on the lever bar, the downward force is transmitted through the space to the lid so as to result in substantially equal pressure being exerted by the lid's peripheral edges onto the edges of the dump tank's top opening to form a liquid-tight seal.

12. The assembly of claim 11 further comprising latching means to retain the lever bar in its closed position.

13. The assembly of claim 12 wherein the directional flow control valve is a manual valve.

14. The assembly of claim 11 wherein the top edge of the dump tank's neck has an O-ring groove in the center and is beveled on each side.

15. The assembly of claim 14 wherein the directional flow control valve is a check valve.

16. The assembly of claim 1 wherein the shrink-fit covering extends to near the fill tube's first extremity.

17. The assembly of claim 1 wherein the cover is hingably attached to the neck of the dump tank.

18. An assembly for use with an underground liquid storage tank to control overfill of liquid during a filling operation, comprising:

(a) A dump tank molded of one piece construction from a polymeric material and dimensioned to hold up to about thirty-five gallons of liquid having a double-walled neck with an opening at its tip whereby access is gained to the interior of the dump tank and an opening at a bottom wall to accommodate a fill tube;

(b) a fill tube securely positioned in said dump tank with a first extremity near the dump tank's neck and a second extremity extending through the opening in the dump tank's bottom wall, further wherein an extension of the bottom wall extends at least one inch along the fill tube's length from the point where the fill tube's second extremity enters said dump tank bottom wall to form a shrink-fit covering on the fill tube to ensure that liquid which spills into the dump tank will not seep therethrough;

(c) attachment means for securing the fill tube in the dump tank, said attachment means being a plate which is permanently attached to the fill tube near the first extremity and to an interior wall of the double-walled neck, said plate having openings for allowing excess liquid to pass therethrough and further wherein the double-walled neck and attachment means are unitary in structure;

(d) piping extending from the dump tank's interior bottom to the fill tube;

(e) a directional flow control valve associated with the piping through which overfilled liquid can flow in response to said valve's opening; and (f) a cover for fitting over the opening at the top of the dump tank so as to form a sealed closing of the dump tank.

19. The assembly of claim 18 wherein the fill tube is secured to the dump tank near the second extremity of said fill tube by the bottom wall of the dump tank.

20. The assembly of claim 19 wherein the plate has openings for allowing overfilled liquid to pass therethrough.

21. The assembly of claim 20 wherein the shrink-fit covering on the fill tube extends to near the fill tube's first extremity.

* * * * *